United States Patent [19]

Southard

[11] Patent Number: 4,620,610

[45] Date of Patent: Nov. 4, 1986

[54] TREE STEP

[76] Inventor: Benny S. Southard, 315 S. Chapman, Greensboro, N.C. 27403

[21] Appl. No.: 810,487

[22] Filed: Dec. 19, 1985

[51] Int. Cl.[4] ..... A63B 29/04; A63B 27/00

[52] U.S. Cl. ..... 182/92; 182/228; 248/293

[58] Field of Search ..... 182/92, 91, 90, 187, 182/188, 228; 248/293, 219.4

[56] References Cited

U.S. PATENT DOCUMENTS

| | | | |
|---|---|---|---|
| 480,941 | 8/1892 | Stow | 173/129 |
| 1,153,750 | 9/1915 | Berry | 182/92 |
| 3,283,852 | 11/1966 | Merz et al. | 182/92 |
| 3,358,789 | 12/1967 | Laun | 182/187 |
| 3,380,697 | 4/1968 | Melcher | 182/92 |
| 3,598,201 | 8/1971 | Thurmond | 182/92 |
| 3,746,294 | 7/1973 | Johnston | 248/219.4 |
| 4,027,742 | 6/1977 | House | 182/92 |
| 4,109,761 | 8/1978 | Matlock | 182/92 |
| 4,402,385 | 9/1983 | Buche | 182/92 |
| 4,413,706 | 11/1983 | Michael | 182/92 |
| 4,422,527 | 12/1983 | Schultz et al. | 182/92 |
| 4,449,612 | 5/1984 | Southard | 182/92 |

*Primary Examiner*—Reinaldo P. Machado

*Attorney, Agent, or Firm*—Griffin, Branigan, & Butler

[57] ABSTRACT

A tree step (20) comprises a first member (24) which has a second member (30) pivotally connected thereto. Connected to the first member (24) is a braided rope (28) which substantially encircles a tree when the tree step (20) is in an installed configuration. The second member (30) includes a foot-support portion (60) which has a spacer portion (62) integral therewith at a proximal end thereof. The spacer portion (62) serves to space a pivot point (82) from foot-supporting surfaces (72, 74) to a sufficient extent that, when the second member (30) has the braided rope (28) wound therearound, and when the second member (30) is pivoted to a storage configuration, the braided rope (28) is securely engaged between the foot-supporting surfaces (72, 74) and the first member (24). The spacer portion (62) has stabilization flanges (96, 98) extending rearwardly therefrom, the backsides of which provide stabilization surfaces (100, 102) which contact the tree when the tree step (20) is in an installed configuration. Rounded corners (104, 106) are provided on the flanges (96, 98) to facilitate snug engagement of the tree step (20) about the tree. The second member (30) is locked securely in its installed configuration with respect to the first member (24) by virtue of tapering sidewalls (66, 68) and a shoulder (94) provided on the second member (30).

11 Claims, 4 Drawing Figures

TREE STEP

BACKGROUND OF THE INVENTION

1. Field of the Invention

This invention pertains to apparatus for assisting a human, such as a hunter or a woodsman, in climbing a tree or pole.

2. Prior Art and Other Considerations

Hunters and woodmen have long used climbing assistance devices to facilitate rapid ascent up trees and poles. Such devices generally have a member which extends essentially radially from the tree (in order to provide a surface upon which one can place his foot as he climbs the tree), as well as a member whereby the device engages the tree. In the prior art it has been known to engage such devices to a tree both by tree-invasive fasteners (such as rivets, nails, and screws), and also by non-invasive means of the type which generally encircle a tree (such as a rope or chain). It is particularly the tree-encircling, non-invasive climbing assistance devices to which this invention pertains.

Prior art teachings of tree-encircling, non-invasive climbing assistance devices include those shown in U.S. Pat. Nos. 3,598,201 to Thurmond and 4,422,527 to Schultz et al. The patent to Thurmond teaches the hinged connection of two members comprising a tree-encircling climbing device. Several problems are encountered in the usage of such prior art devices.

After a tree-encircling climbing assistance device is installed on a tree, the application of force resulting from the weight of the climber should cause the device to slip down the tree by a fraction of an inch to better lodge the device against the tree. Unfortunately, however, many prior art devices have sharp corners which undesirably snag against bark and preclude proper slippage, and hence preclude proper lodgement of the device against the tree.

Another problem associated with prior art climbing assistance devices is the tendency from such devices to wobble from side-to-side, often resulting in precarious footing for the climber.

A further problem associated with tree-encircling climbing assistance devices is the awkwardness of storing and conveniently transporting such devices. The straggling ropes or chains used to encircle the tree are hard to maintain in compact configuration and can easily get entangled in other gear and accessories. The hunter or woodsman desires to be mobile and unfettered by sources of potential entaglement.

In view of the foregoing, it is an object of this invention to provide a climbing assistance device which snugly and properly engages a tree or pole.

An advantage of the present invention is the provision of a climbing assistance device which is easily oriented into a compact storage configuration wherein tree-encircling elements are securely engaged.

A further advantage of the present invention is the provision of a climbing assistance device which provides a stabilized foothold for a climber.

SUMMARY

A tree step comprises a first member which has a second member pivotally connected thereto. Connected to the first member is a braided rope which substantially encircles a tree when the tree step is in an installed configuration. The second member includes a foot-support portion which has a spacer portion integral therewith at a proximal end thereof. The spacer portion serves to space a pivot point from foot-supporting surfaces to a sufficient extent that, when the second member has the braided rope wound therearound, and when the second member is pivoted to a storage configuration, the braided rope is securely engaged between the foot-supporting surfaces and the first member. The spacer portion has stabilization flanges extending rearwardly therefrom, the backsides of which provide stabilization surfaces which contact the tree when the tree step is in an installed configuration. Rounded corners are provided on the flanges to facilitate snug engagement of the tree step about the tree. The second member is locked securely in its installed configuration with respect to the first member by virtue of tapering sidewalls and a shoulder provided on the second member.

BRIEF DESCRIPTION OF THE DRAWINGS

The foregoing and other objects, features, and advantages of the invention will be apparent from the more specific description of preferred embodiments of the invention as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE DRAWINGS

Figure 1:
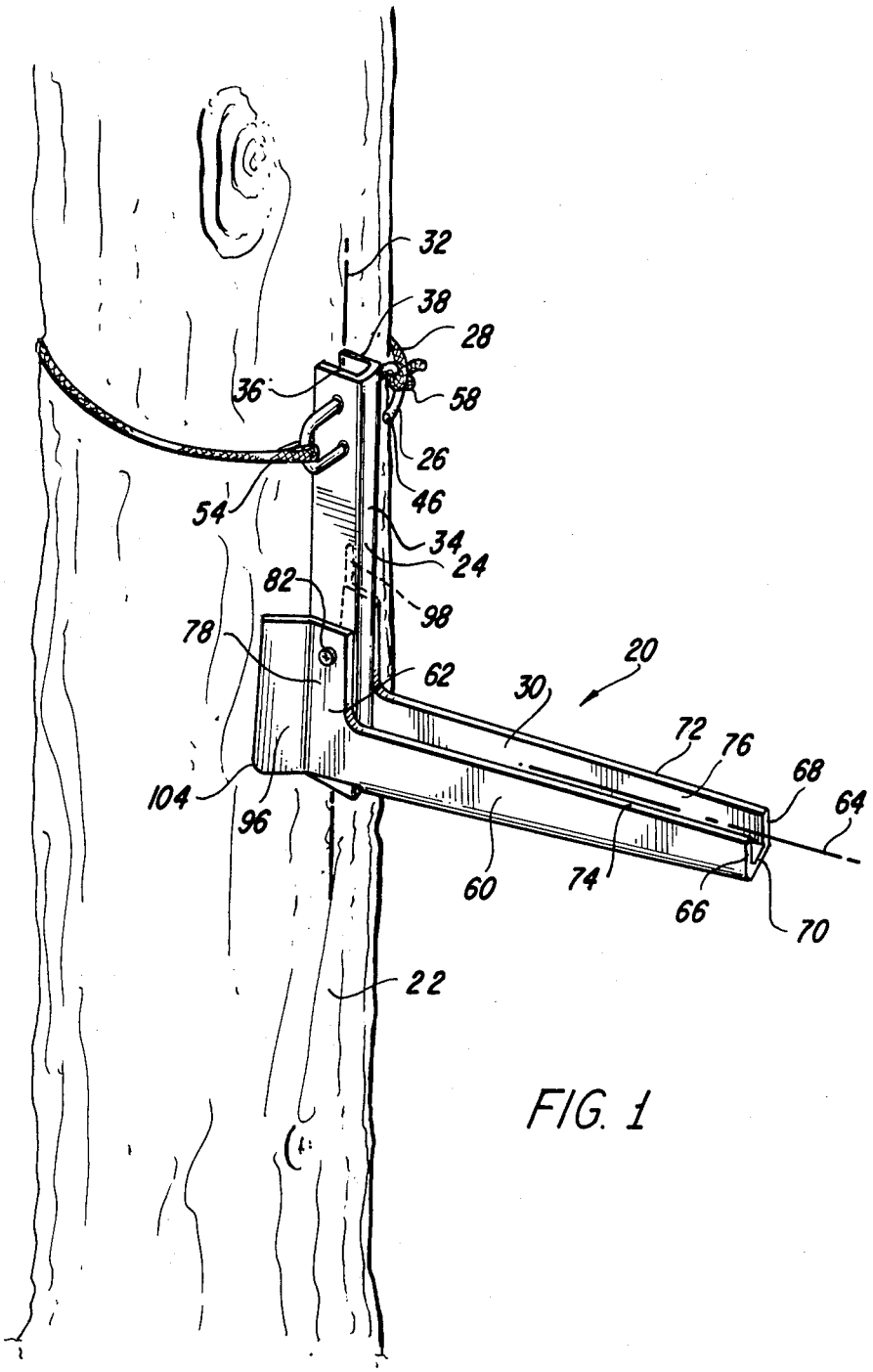
FIG. 1 is a front perspective view of a tree step according to an embodiment of the invention in an installed configuration on a tree.

FIG. 1 shows a tree step 20 according to the invention installed on a tree 22. The tree step 20 comprises a first member 24; means for substantially encircling the tree (including hook 26 and braided rope 28); and, a second member 30 which is pivotally connected to the first member 24.

The first member 24 is an elongated piece of angle iron having substantially uniform cross-section along a major axis 32 thereof. The first member has a front wall 34 and opposing sidewalls 36 and 38. Sidewall 36 has two apertures 40 and 42 formed therein to accommodate hook 26; sidewall 38 has aperture 44 formed therein to accommodate hook 26.

Figure 2:
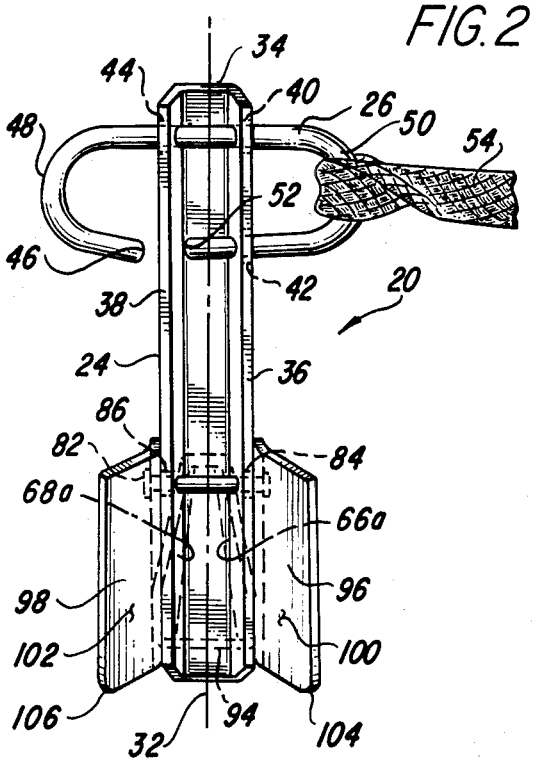
FIG. 2 is a rear view of the tree step of the embodiment of FIG. 1.

As seen in FIG. 2, hook 26 has a first end 46 which is spaced away from sidewall 38 and extends away from sidewall 38. At its first lateral extremity 48 a hook 26 is curved through 180 degrees, from which the hook 26 extends through the apertures 44 and 40 toward the second lateral extremity 50. At the second lateral extremity 50 hook 26 is curved through 180 degrees whereby the hook 26 extends toward and through aperture 42 of sidewall 36, terminating just short the interior surface of sidewall 38 at hook second end 52.

At hook extremity 50 the braided rope 28 is securely doubled back or spliced into itself as shown at 54 for permanent connection to hook 26. When the tree step 20 is in an installed configuration, an otherwise free end 56 of the braided rope 28 is slipped through the gap which exists between hook end 46 and sidewall 38 and securely tied (as indicated by knot 58) about hook second lateral extremity 50.

Second member 30 comprises an elongated foot-supporting portion 60 and a spacer portion 62 integral with a proximal end of the portion 60. The elongated portion 60 is a piece of angle iron which extends along an axis of elongation 64. Foot support 60 has sidewalls 66 and 68, a lower wall or lower surface 70, and upper surfaces 72, 74 which are the top edges of sidewalls 68 and 66, respectively.

Figure 3:
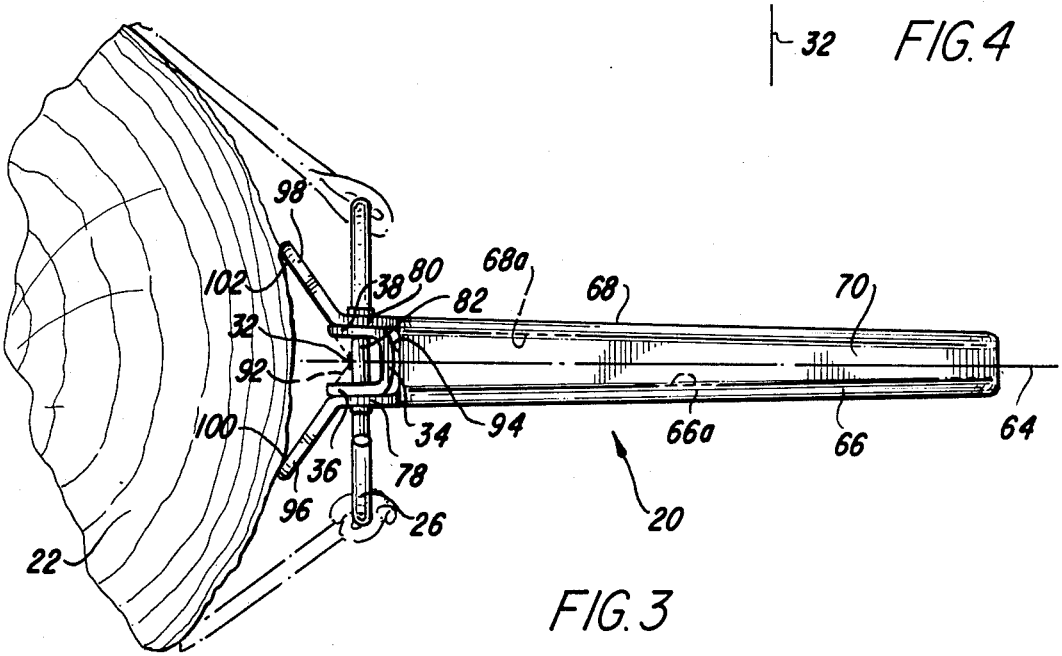
FIG. 3 is a bottom view of the tree step of the embodiment of FIG. 1 in an installed configuration on a tree; and, FIG. 4 is a side view of the tree step of the embodiment of FIG. 1 in a storage configuration.

As seen in FIG. 3, as the foot support 60 extends from its proximal end to its distal end, the interior surfaces 68*a* and 66*a* of sidewalls 68 and 66, respectively, converge toward the axis of elongation 64.

Figure 4:
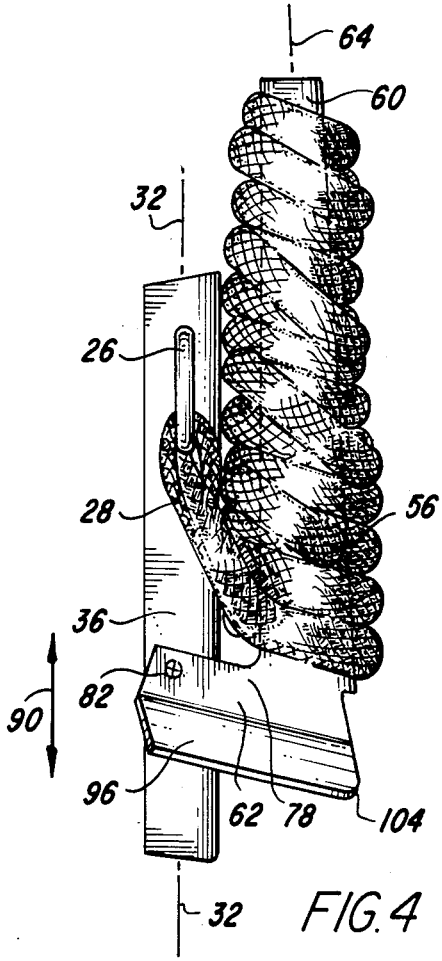

The spacer portion 62 of second member 30 is integrally formed at the proximal end of foot support 60. Spacer 62 has sidewalls 78 and 80 which are spaced apart so that first member 24 can be pivotally received therebetween. A pivot pin 82 extends through sidewall 78, through an aperture 84 formed in first member sidewall 36, through an aperture 86 formed in first member sidewall 38, and through spacer sidewall 80. In the illustrated embodiment, pivot pin 82 is located a distance indicated by the arrow 90 (see FIG. 4) from an end of the first member, the distance 90 being about one-third the total length of the first member 24 along its major axis 32. The pivot pin 82 extending through spacer 60 is spaced away from the plane in which foot-supporting upper surfaces 72 and 74 lie to a sufficient extend that, when the second member 30 has the braided rope 28 wound therearound, and when the second member 30 is pivoted to a storage configuration (wherein the axis of elongation 64 of member 30 approaches a parallel relationship whth major axis 32 of member 24), the braided rope 28 is securely engaged between the surfaces 72 and 74 and the first member 24 as shown in FIG. 4. The engagement of rope 28 and particularly the retention or engagement of rope end 56 between surfaces 72 and 74 and the first member 24 keeps the tree step 20 compact and precludes the rope 28 from dangling when the tree step 20 is in the storage configuration.

The lower surface 70 of second member 30 has a notch 92 formed therein which terminates at a shoulder 94. As shown in FIG. 3, when the member 30 of the tree step 20 is pivoted to its installed configuration the converging interior surfaces 66*a* and 68*a* of sidewalls 66 and 68 bear against the sidewalls 36 and 38, respectively, of first member 24, and shoulder 94 bears against front wall 34 of member 24, thereby forming a secure lock for the second member 30.

Extending rearwardly from the spacer sidewalls 78 and 80 are stabilizing flanges 96 and 98, respectively. As seen in FIG. 3, flanges 96 and 98 are on opposite sides of the first member 24 and are angled outwardly with respect to the major axis 32 of the first member 24. The backsides of flanges 96, 98 provide stabilization surfaces 100, 102, respectively, which contact the tree when the tree step 20 is in an installed configuration. The stabilization surfaces 100, 102 tend to reduce wobbling of the tree step 20.

The lower corners 104, 106 of the flanges 96, 98, respectively, are formed in smooth arcuate fashion. Advantageously, when the tree step 20 is installed on a tree, the smooth, rounded corners 104, 106 permit the tree step 20 to slip approximately one-fourth inch as is desired for snug engagement of the tree step 20 about the tree.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined by the following:

1. A tree step comprising:

a first member orientable to have a major axis thereof extended essentially vertically when said tree step is in an installed configuration on a tree;

means connected proximate a first end of said first member for substantially encircling a tree; and, a second member pivotally connected to said first member proximate a second end of said first member, said second member being pivotable to a first position in said installed configuration wherein a portion of said second member is oriented to serve as a support for a foot placeable thereon, and wherein said second member further comprises a pair of spaced-apart flanges which when said tree step is in said installed configuration are on opposite sides of said first member and angled outwardly from said major axis of said first member to provide tree-contacting surfaces.

2. The apparatus of claim 1, wherein said flanges have curved bottom corners whereat said flanges contact a tree.

3. The apparatus of claim 1, wherein said second member is pivotable to a second position wherein, when said tree step is in a storage configuration, said tree encircling means can be wound around said first member and engaged between said first member and said foot-support portion of said second member.

4. The apparatus of claim 1, wherein said foot-supporting portion of said second member has an upper surface which serves as a foot-supporting surface when said tree step is in an installed configuration, a lower surface, and two sidewalls connecting at least portions of said upper surface and said lower surface, said sidewalls each having interior surfaces thereof, and wherein in said installed configuration at least portions of said interior surfaces of said sidewalls bear against said first member.

5. The apparatus of claim 4, wherein as said interior sidewalls extend toward a distal end of said second member said interior sidewalls are angled to converge toward a longitudinal axis of said foot-supporting portion of said second member.

6. The apparatus of claim 4, wherein said lower surface of said foot-supporting member has a notch formed therein which terminates at a shoulder, said shoulder being adapted to bear against said first member when said foot step is in said installed configuration.

7. A tree step comprising:

a first member orientable to at least partially bear against a tree when said tree step is in an installed configuration on a tree;

means connected to said first member for substantially encircling a tree; and, a second member pivotally connected to said first member and comprising a foot-supportable portion and a spacer portion integral therewith, said second member being pivotally connected to said first member at said spacer portion, said spacer portion having stabilization flanges thereon for bearing against a tree when said tree step is in an installed configuration, said spacer portion serving to space said foot-supportable portion sufficiently from said first member when said second member is pivoted to a storage configuration whereby said tree encircling means can be wound around said foot-supporting portion of said second member and engaged between said first member and said foot-supporting portion of said second member.

8. The apparatus of claim 7, wherein said flanges have curved bottom corners whereat said flanges contact a tree.

9. The apparatus of claim 7, wherein said foot-supporting portion of said second member has an upper surface which serves as a foot-supporting surface when said tree step is in an installed configuration, a lower surface, and two sidewalls connecting at least portions of said upper surface and said lower surface, said sidewalls each having interior surfaces thereof, and wherein in said installed configuration at least portions of said interior surfaces of said sidewalls bear against said first member.

10. The apparatus of claim 9, wherein as said interior sidewalls extend toward a distal end of said second member said interior sidewalls are angled to converge toward a longitudinal axis of said foot-supporting portion of said second member.

11. The apparatus of claim 9, wherein said lower surface of said foot-supporting member has a notch formed therein which terminates at a shoulder, said shoulder being adapted to bear against said first member when said foot step is in said installed configuration.

* * * * *